US007077376B2

(12) United States Patent
Agnoni et al.

(10) Patent No.: US 7,077,376 B2
(45) Date of Patent: Jul. 18, 2006

(54) WATER SAVER VALVE

(75) Inventors: Ralph Agnoni, Liberty, PA (US); James E. Bryan, Canton, PA (US); David M. Lanzer, South Williamsport, PA (US)

(73) Assignee: Devas, Inc., South Williamsport, PA (US)

( * ) Notice: Subject to any disclaimer, the term of this patent is extended or adjusted under 35 U.S.C. 154(b) by 121 days.

(21) Appl. No.: 10/938,926

(22) Filed: Sep. 9, 2004

(65) Prior Publication Data

US 2006/0048813 A1 Mar. 9, 2006

(51) Int. Cl.
*F16K 31/12* (2006.01)

(52) U.S. Cl. ..... 251/47; 137/456; 251/48

(58) Field of Classification Search ..... 251/25, 251/47, 50, 36, 48; 137/456, 460, 462
See application file for complete search history.

(56) References Cited

U.S. PATENT DOCUMENTS 2,732,165 A * 1/1956 Collingwood ..... 251/25
3,568,705 A * 3/1971 Boyadjieff et al. ..... 137/87.04
4,522,229 A * 6/1985 Van de Moortele ..... 137/460
4,964,421 A * 10/1990 Klaus ..... 137/460

* cited by examiner

*Primary Examiner*—Justine R. Yu
*Assistant Examiner*—Andrew J. Rost
(74) *Attorney, Agent, or Firm*—Thomas R. Shaffer, Esq.

(57) ABSTRACT

The present invention relates to a valve designed to be in series with a toilet water supply line and the inlet of a toilet tank so that water which is flowing into the tank must flow through the valve. The valve includes a shutoff spool that is actuated by an intensifier piston. When the water volume exceeds the tank capacity due to a failure of the float valve in the toilet supply tank, the shutoff spool is actuated by the intensifier piston allowing flow to the toilet to be blocked.

23 Claims, 5 Drawing Sheets

WATER SAVER VALVE

BACKGROUND OF THE INVENTION

1. Field of the Invention

The present invention relates to a water saver valve. More particularly, the present invention relates to a water saver valve for water consumption devices such as toilets and the like which prevents excess water usage even in the event of a water consumption device failure.

2. Prior Art

The provision of a water saver valve coupled to the inlet of a toilet tank is known in the art. Klaus, U.S. Pat. No. 4,964,421, discloses one such device. The Klaus device, however, utilizes a complex and expensive hour glass shaped chamber in combination with a gate which is activated by a pilot valve sensing pressure across a flow restriction. The Klaus device also utilizes a variable restrictor which requires an external tool for fine adjustment.

There remains a need for a water saver valve which is simple in its design, relatively inexpensive, less complex and one which is less likely to become stuck or fail from a lack of use.

SUMMARY OF THE INVENTION

The present invention provides such a water saver valve. In its simplest form, the present invention includes an intensifier piston chamber including a reciprocating piston movable by fluid pressure between a first position and a second position, a shutoff spool chamber juxtaposed to said piston chamber, a control spool chamber, an inlet having a supply orifice connected to said shutoff spool chamber and having a control spool supply line connected to said control spool chamber, an outlet having an outlet orifice connected to said shutoff spool chamber and having a pilot line connected to said control spool chamber, a piston first position supply line connected from a first side of said piston to said control spool chamber and a piston second position supply line connected from a second side of said piston to said control spool chamber and a drain tank line port. A shutoff spool is positioned in said shutoff spool chamber said shutoff spool movable between a first open position and a second closed position, said shutoff spool being biased to said first open position and movable to said second closed position by direct physical contact by said piston against said shutoff spool. A control spool is positioned in said control spool chamber to control movement of said intensifier piston.

Preferably, the shutoff spool is spring biased to said first open position.

Preferably, the control spool is movable from a first position to a second position by fluid pressure from said pilot line and movable from said second position to said first position by fluid pressure from said control spool supply line, said control spool supply line providing a fluid connection to said piston first position supply line when said control spool is in said first position causing movement of said piston in a first direction, said control spool supply line providing a fluid connection to said piston second position supply line when said control spool is in said second position causing movement of said piston in a second direction and said piston first position supply line being connected through said control spool to said drain line when said control spool is in said second position.

Preferably, the control spool supply line provides said fluid connection to said piston first position supply line and to said piston second position supply line through a control spool passageway in said control spool.

Preferably, the control spool has an outward end which extends at least partially out of a housing containing said control spool chamber and control spool.

Preferably, the control spool is also movable from a first position to a second position by manually depressing said outward end of said control spool.

The supply orifice preferably has a diameter of approximately 0.125 inches. The outlet orifice preferably has an internal diameter of between 0.125 inches and 0.140 inches. The pilot line preferably has an internal diameter between 0.062 inches and 0.078 inches.

Preferably, the control spool supply line and said pilot line provide equal fluid pressure to opposite ends of said control spool when fluid needs of a water consumption device connected to the outlet is satisfied. Preferably, the pilot line provides fluid pressure to a larger surface area of said control spool than is provide by said control spool supply line thus biasing said control spool to said second control spool position when equal fluid pressure is provided to opposite ends of said control spool.

Preferably, the piston and said control spool are caused to move from said first position to said second position and back to said first position every time fluid is caused to flow from said inlet to said outlet thus reducing the possibility that said moving components might become frozen in place because of infrequent use.

Preferably, the water saver valve provides an automatic reset function whereby said piston, said shutoff spool and said control spool are each initially biased in a first position which allows fluid to flow unrestricted from said inlet line to said outlet line for a period of time required for said piston to move by fluid pressure to said second position, after fluid needs of a water consumption device are satisfied fluid pressure then causing said control spool to move to said second position and causing said piston to move back to said first position.

Preferably, the control spool is biased to said first position by fluid pressure when fluid flow is passing from the inlet to the outlet.

Preferably, the control spool is biased to said first position by fluid pressure when said shutoff spool is in a said second closed position.

Preferably, the control spool is biased to said second position by fluid pressure when a fluid flow cannot pass from said inlet to said outlet because fluid needs of a water consumption device connected to said outlet have been satisfied.

Preferably, the control spool is biased to said second position by providing a control spool with a larger surface area subjected to fluid pressure from said pilot line and a smaller surface area subjected to fluid pressure from said control spool supply line. Preferably, the larger surface area is approximately 1.3 times as large as said smaller surface area.

Preferably, the water saver valve provides a device failure function whereby if flow continues to enter said inlet for a period of time longer than that required for said piston to move from said first position to said second position said shutoff spool will be pushed to its second closed position, said piston and said shutoff spool will remain in said second position until said control spool is manually reset or until fluid ceases to enter said inlet.

Preferably, said inlet is connected to a water supply line and said outlet is connected to an inlet to a water consumption device such as a toilet, washing machine, water heater or the like.

Preferably, the intensifier piston chamber and said shutoff spool chamber are provided in a first housing and said control spool chamber is provided in a second housing hydraulically connected to said first housing.

Alternatively, the intensifier piston chamber, said shutoff pool chamber and said control spool chamber are provided in a single housing.

DETAILED DESCRIPTION OF THE PREFERRED EMBODIMENTS

Figure 1:
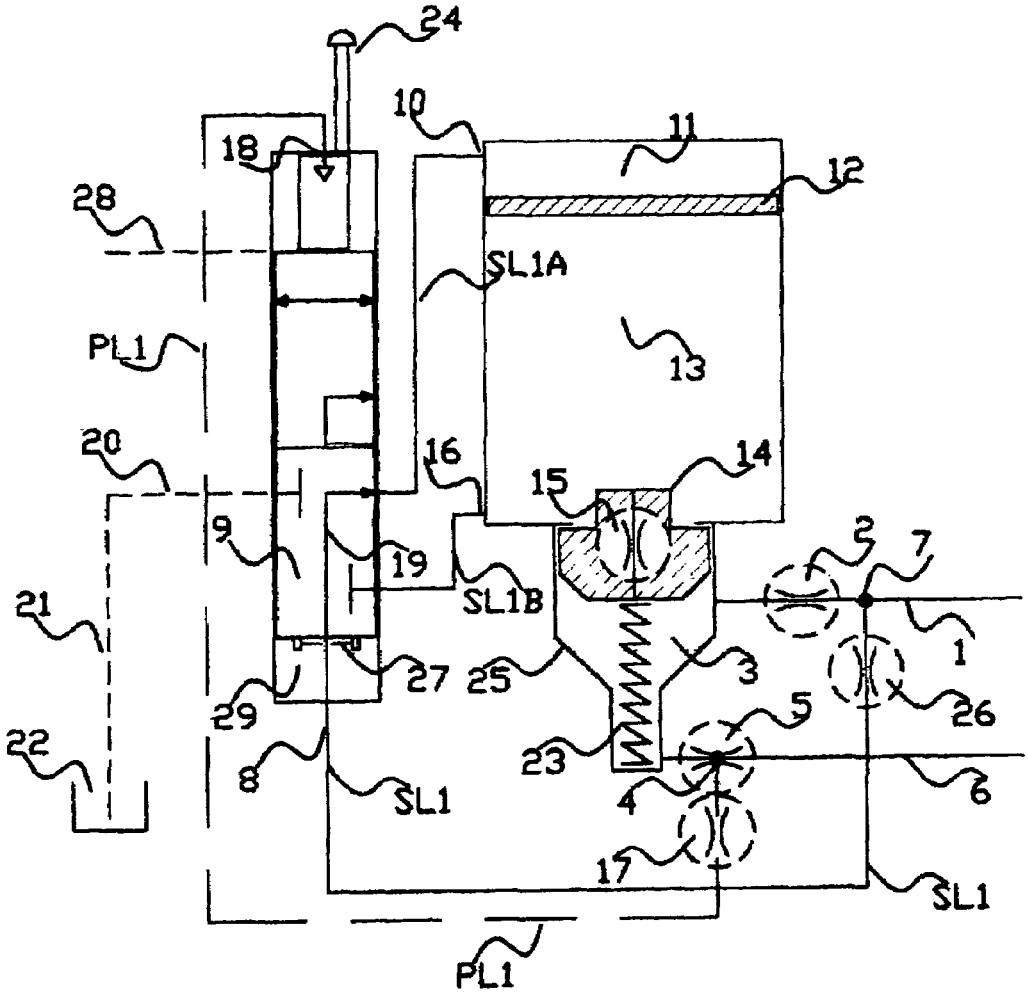
FIG. 1 is a hydraulic schematic diagram of the present invention.
Figure 2A:
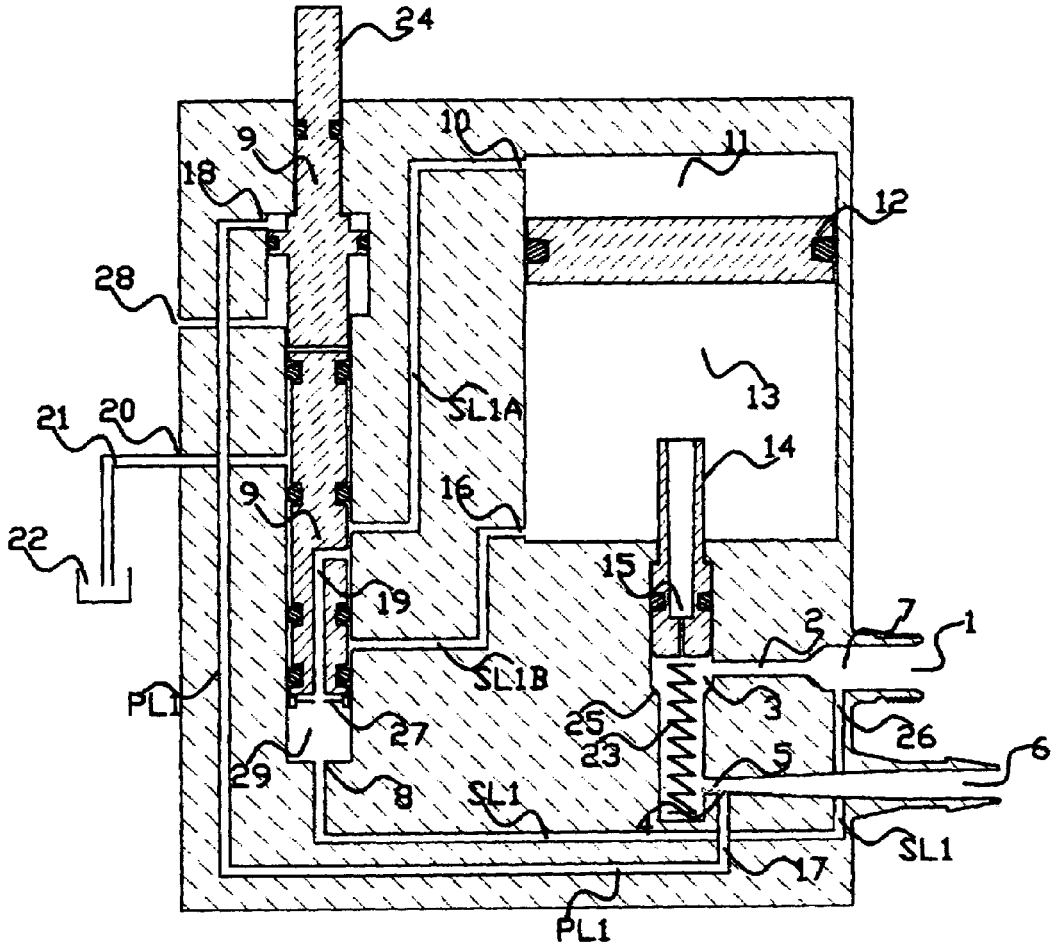
FIG. 2A is a cross-sectional view of the present invention with the piston, control spool and shutoff valve each in a first position.
Figure 2B:
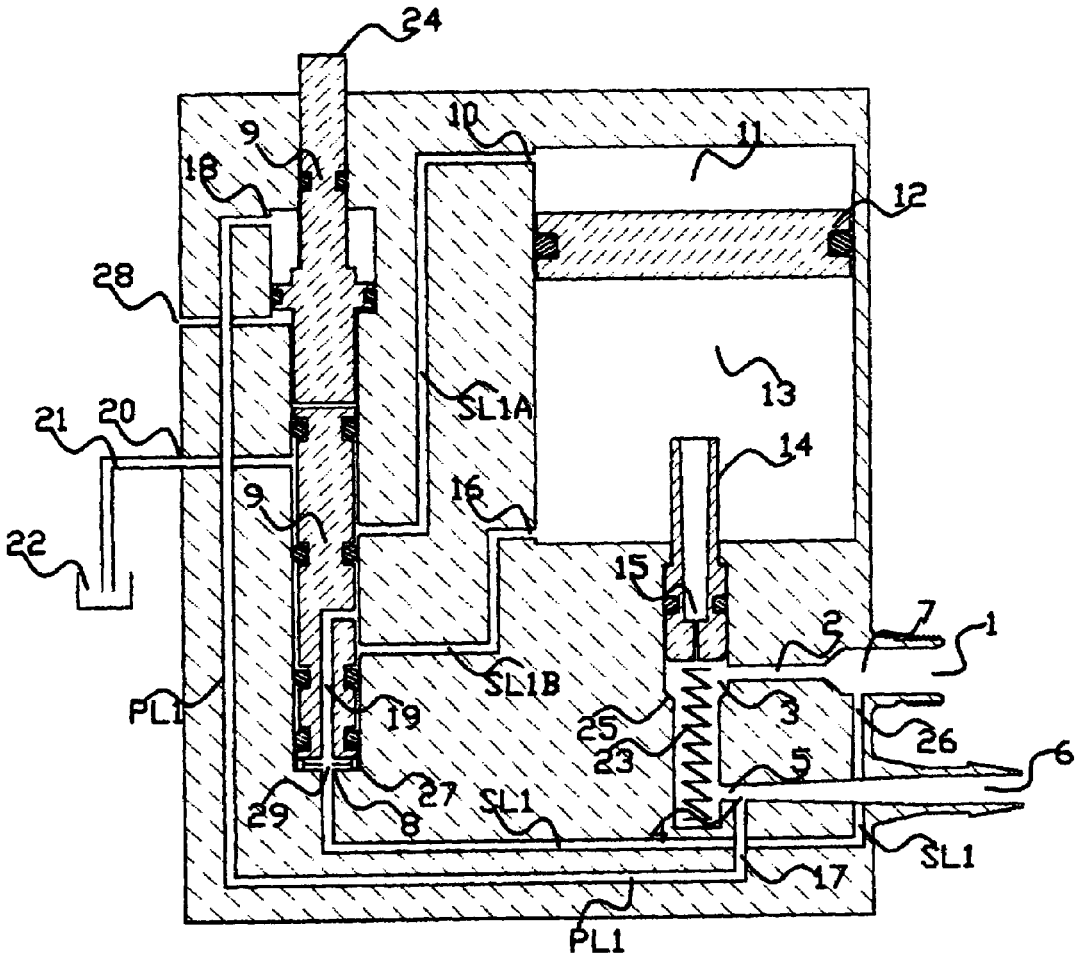
FIG. 2B is a cross-sectional view of the present invention with the piston and the shutoff valve in a first position and the control spool in a second position.
Figure 2C:
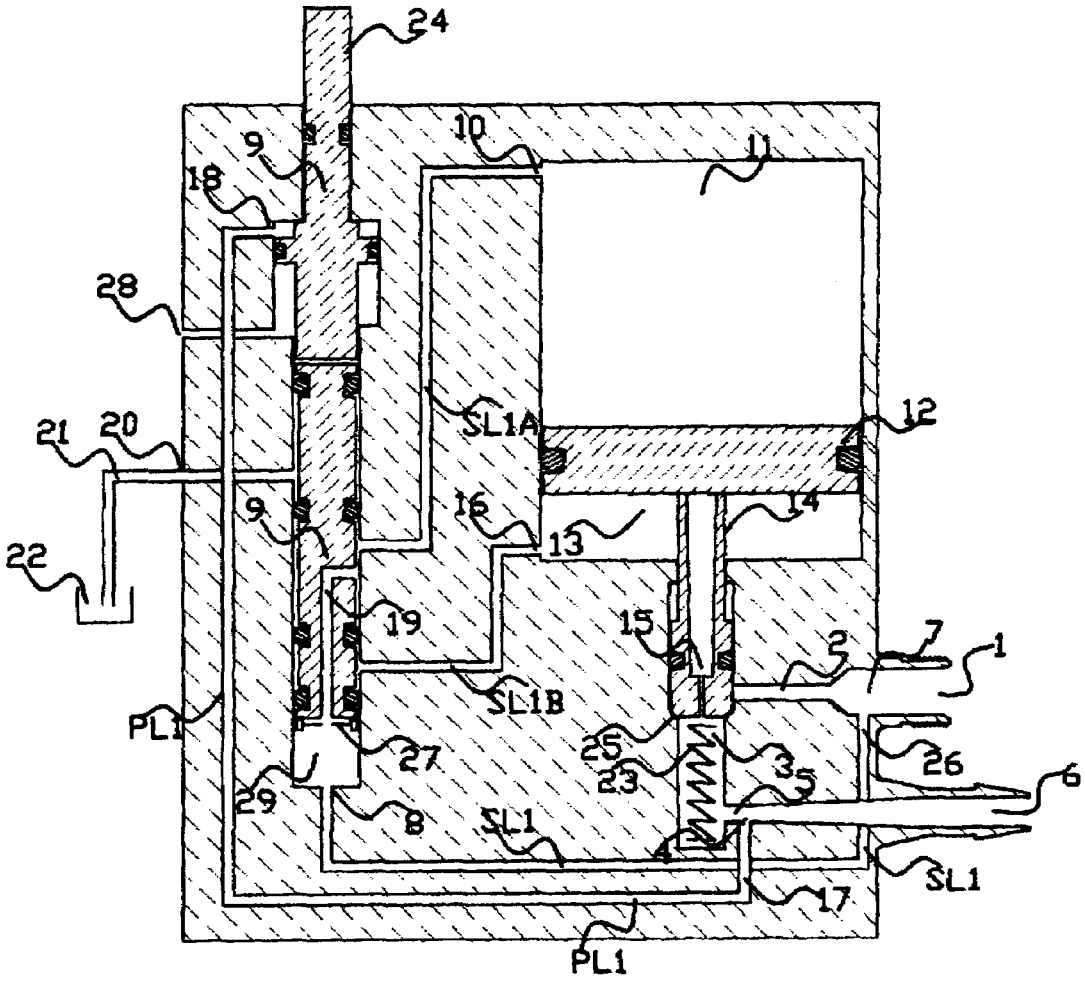
FIG. 2C is a cross-sectional view of the present invention with the piston and the shutoff valve in a second position and the control spool in a first position.
Figure 3:
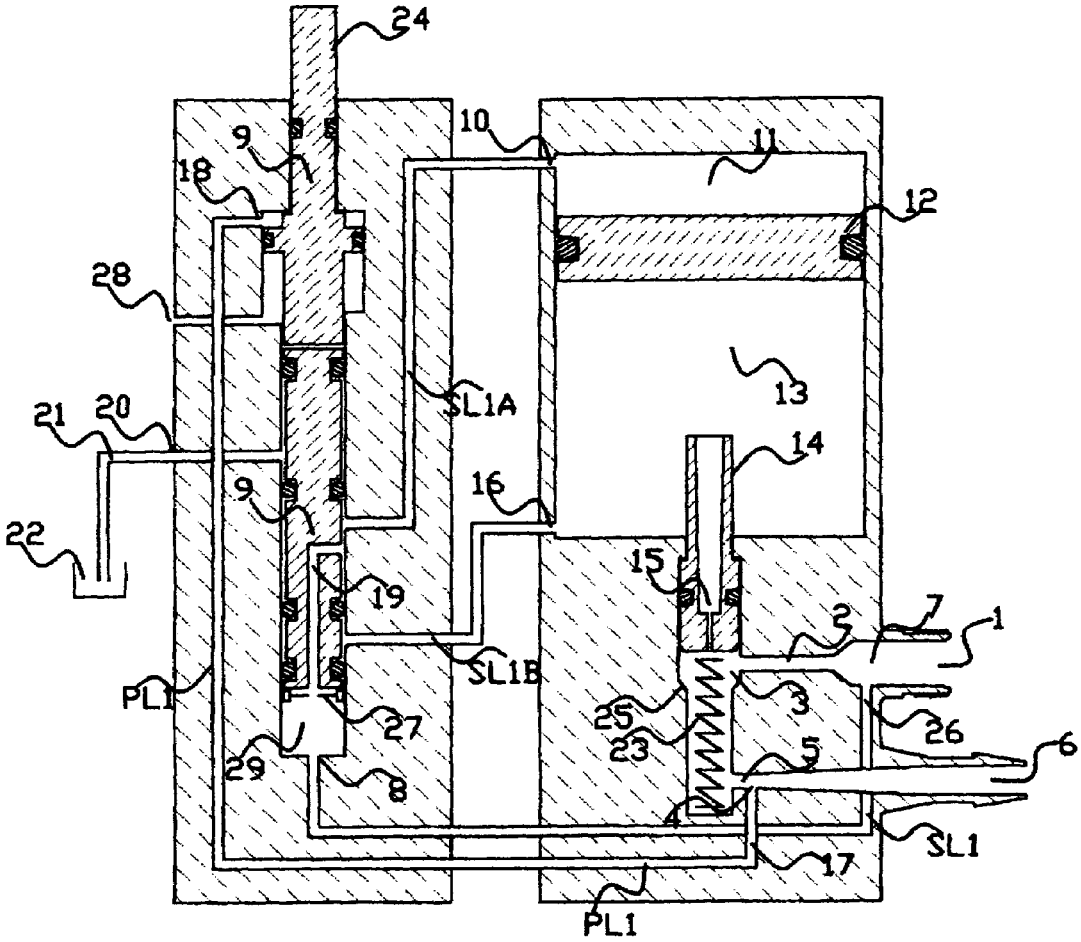
FIG. 3 is a cross-sectional view of the present invention with the control spool shown in a first housing and the piston and the shutoff valve in a second housing.

Referring to the Figures, the following is a listing of component names and reference numbers as utilized in the following descriptions.

Device inlet (1)
Supply orifice (2)
Shutoff spool chamber (3)
Outlet diversion (4)
Outlet orifice (5)
Outlet port (6)
Inlet diversion (7)
Supply port of the control spool (8)
Control spool, 2 piece (9)
Supply port of the intensifier piston extend chamber (10)
Intensifier piston extend chamber (11)
Reciprocating piston (12)
Intensifier piston retract chamber (13)
Shutoff spool (14)
Shutoff spool orifice (15)
Supply port of the intensifier piston retract chamber (16)
Control spool pilot orifice (17)
Control spool pilot port (18)
Control spool passageway (19)
Tank port of the control spool (20)
Drain tank line (21)
Drain tank (22)
Shutoff spool biasing spring (23)
Manual reset button of the control spool (24)
Shutoff spool seat (25)
Control spool supply orifice (26)
Control spool screen (27)
Exhaust port (28)
Control spool chamber (29)
Control spool pilot line (PL1)
Control spool supply line (SL1)
Piston first position supply line (SL1A)
Piston second position supply line (SL1B)

The present invention is designed to operate in three different functional modes which will be described in detail below as an Operational Mode with Auto Reset Function; an Operational Mode with Outlet Device Failure and No Reset; and a Manual Reset of the Valve.

Operational Mode with Auto Reset Function

In this mode, water flows into the device inlet (1) at a specified minimum of 25 dynamic psi diverting into the 0.125" supply orifice (2) flowing through the shutoff spool chamber (3), into the outlet diversion (4) through the 0.125"–0.140" outlet orifice (5) to the device connected to the outlet port (6). The device connected to the outlet port (6) will begin to be filled with water through the described circuit.

As the device connected to the outlet port (6) is being filled with water, water also flows through the device inlet (1) to the inlet diversion (7) through the control spool supply orifice (26) through control spool supply line (SL1) then into the supply port of the control spool (8) through the 0.011" perforated control spool screen (27), which filters debris, creating and maintaining pressure to allow biasing of the control spool then through the control spool passageway (19) through piston first position supply line (SL1A) diverting the flow of water through the supply port of the intensifier piston extend chamber (10) to the intensifier piston extend chamber (11) allowing pressure and volume to build on the reciprocating piston (12) causing movement of the reciprocating piston (12) to move into the direction of the intensifier piston retract chamber (13) forcing water to be emptied from the intensifier piston retract chamber (13) through the shutoff spool orifice (15) located in the shutoff spool(14).

The shutoff spool (14) will be held in the open position by the shutoff spool biasing spring (23) allowing water to flow through the shutoff spool chamber (3) to the outlet diversion (4) through the outlet orifice (5) which upon diverging and converging of fluid at the outlet orifice (5), a venturi effect is created which causes a vacuum or a minimal pressure that will assist the biasing of the control spool then fluid flows to the device connected to the outlet port (6). Thus the reciprocating piston (12) has begun its timing function directly related to the volume of the water flow.

Upon reaching the capacity satisfaction of the device located at the outlet port (6), the auto reset function of the circuit shall occur as follows:

Water flows into the device inlet (1) diverting into the supply orifice (2) flowing through the shutoff spool chamber (3), into the outlet diversion (4) and is blocked from entering the outlet orifice (5) because the device connected to the outlet port (6) has been satisfied and will block water flow. The water at the outlet diversion (4) will be forced to go through the 0.0625" control spool pilot orifice (17) through control spool pilot line (PL1) causing pressure to be present at the control spool pilot port (18) to overcome the biasing of the control spool, creating a force to move the control spool (9) which is shown as a two piece design, the upper piston has an area of 0.41 sq./in. and the lower piston has an area of 0.31 sq./in., which could be manufactured as one piece, then allowing trapped air to exit through the exhaust port (28). A diversion of water will occur from the device inlet (1) to the inlet diversion (7) through the control spool supply orifice (26) through control spool supply line (SL1) to the supply port of the control spool (8) through the control spool passageway (19) through piston second position supply line (SL1B) to flow to the supply port of the intensifier piston retract chamber (16) causing water to be supplied to the intensifier piston retract chamber (13) causing pressure to be created at the intensifier piston retract chamber (13) causing movement of the reciprocating piston (12) to move in the direction of the intensifier piston extend chamber (11). The pressure created at the intensifier piston extend chamber (11) will be forced to flow through the supply port of the intensifier piston extend chamber (10) through piston first position supply line (SL1A) through the control spool (9) to the tank port of the control spool (20) connected to the drain tank line (21) emptying into the drain tank (22).

The foregoing actions allow the total reset of the valve. The reset will be held in position due to the supply pressure being present and the device at the outlet port (6) being satisfied.

The Auto Reset Function described in this section is the normal operational mode of the present invention. Each time a user flushes a toilet (or utilizes a predetermined amount of water from any water consumption device), the actions described above will occur. Because the reciprocating piston (12) and control spool (9) are put into motion on a regular basis, there is less likelihood that these components will become frozen in place because of long periods of remaining in a stationary position.

Operational Mode with Outlet Device Failure and No Reset

When failure of the water consumption device occurs, the following actions occur with the water saver valve of the present invention. Water flows into the device inlet (1) diverting into the supply orifice (2) flowing through the shutoff spool chamber (3), into the outlet diversion (4) through the outlet orifice (5) to the device connected to the outlet port (6). The water consumption device connected to the outlet port (6) will begin to be filled with water through the described circuit. As the device connected to the outlet port (6) is being filled with water, water also flows through the device inlet (1) to the inlet diversion (7) through the control spool supply orifice (26) into the supply port of the control spool (8) creating and maintaining pressure to allow biasing of the control spool then through the control spool passageway (19) diverting the flow of water through the supply port of the intensifier piston extend chamber (10) to the intensifier piston extend chamber (11) allowing pressure and volume to build on the reciprocating piston (12) causing movement of the reciprocating piston (12) to move into the direction of the intensifier piston retract chamber (13) forcing water to be emptied from the intensifier piston retract chamber (13) through the shutoff spool orifice (15) located in the shutoff spool (14). The shutoff spool (14) will be held in the open position by the shutoff spool biasing spring (23) allowing water to flow through the shutoff spool chamber (3) to the outlet diversion (4) through the outlet orifice (5) to the device connected to the outlet port (6). Thus, the reciprocating piston (12) has begun its timing function directly related to the volume of the water flow.

Upon no capacity satisfaction of the device located at the outlet port (6) and after the volume timing function has been reached, the reciprocating piston (12), which was moving in the direction of the shutoff spool (14), will directly contact the shutoff spool (14) and begin to move the shutoff spool (14) in the direction of the shutoff spool biasing spring (23). Supply pressure is present on the reciprocating piston (12) in the intensifier piston extend chamber (11) side of the reciprocating piston (12) creating a force to overcome the pressure of the shutoff spool biasing spring (23) causing the shutoff spool (14) to contact the shutoff spool seat (25) stopping the flow of water from the device inlet (1) flowing through the supply orifice (2) and stopped at the shutoff spool (14) which is now contacting the shutoff spool seat (25). Allowing the flow of water to be stopped to the shutoff spool chamber (3), outlet diversion (4), control spool pilot orifice (17), outlet orifice (5) and the outlet port (6) prevents water from going through to the device which has failed attached to the outlet port (6).

Supply pressure will hold the shutoff spool (14) in place due to the supply pressure being present at the device inlet (1) to the inlet diversion (7) through the control spool supply orifice (26) through control spool supply line (SL1) into the supply port of the control spool (8) creating and maintaining pressure to allow biasing of the control spool then through the control spool passageway (19) through piston first position supply line (SL1A) diverting the flow of water through the supply port of the intensifier piston extend chamber (10) to the intensifier piston extend chamber (11) applied to the reciprocating piston (12).

The valve is now in the shutoff mode due to a device connected to the outlet port (6) failing to stop consuming water at the predetermined consumption level. Simply put water which flows to the "running toilet" or other failed water consumption device is shutoff and remains shutoff until the present invention is manually reset in the manner described below.

Manual Reset of the Valve

Upon the failure of a device connected to the outlet port (6), a manual reset is required after correcting the failure problem.

A manual reset is accomplished as follows: Depress and hold the manual reset button (24) which will move the control spool (9) allowing a diversion of water to occur from the device inlet (1) to the inlet diversion (7) through the control spool supply orifice (26) through control spool supply line (SL1) to the supply port of the control spool (8) then through the control spool passageway (19) diverting the flow of water through piston second position supply line (SL1B) to flow to the supply port of the intensifier piston retract chamber (16) causing water to be supplied to the intensifier piston retract chamber (13) causing pressure to be created at the intensifier piston retract chamber (13) causing movement of the reciprocating piston (12) to move in the direction of the intensifier piston extend chamber (11).

The pressure created at the intensifier piston extend chamber (11) will be forced to flow through the supply port of the intensifier piston extend chamber (10) through piston first position supply line (SL1A) through the control spool (9) to the tank port of the control spool (20) connected to the drain tank line (21) emptying into the drain tank (22). The reciprocating piston (12) will be in the original home or first position and the shutoff spool biasing spring (23) will extend the shutoff spool (14) to the reset (first) position off of the shutoff spool seat (25) which will then allow water to flow into the device inlet (1) diverting into the supply orifice (2) flowing through the shutoff spool chamber (3), into the outlet diversion (4) through the outlet orifice (5) to the device connected to the outlet port (6) allowing the device connected to the outlet port (6) to be filled with water. Release of the reset button (24) allows the pressure to reset the control spool (9) to the biased first position.

The three operational modes have now been described. What may not be apparent to those skilled in the art is that for the present invention to operate properly, some of the dimensions of the various ports, orifices, passageways and other components of the present invention are quite critical and have been discovered only after extensive experimentation. While the present invention is intended for use for a variety of different water consumption devices, the detailed description and the dimensions provided herein have been designed specifically for use of the present invention with a standard toilet.

The invention having been disclosed in connection with the foregoing variations and examples, additional variations will now be apparent to persons skilled in the art. The invention is not intended to be limited to the variations specifically mentioned and accordingly, reference should be made to the appended claims rather than the foregoing discussion of preferred examples, to assess the scope of the invention in which exclusive rights are claimed.

We claim:

1. A water saver valve comprising:

a) an intensifier piston chamber including a reciprocating piston movable by fluid pressure between a first position and a second position, a shutoff spool chamber juxtaposed to said piston chamber, a control spool chamber, an inlet having a supply orifice connected to said shutoff spool chamber and having a control spool supply line connected to said control spool chamber, an outlet having an outlet orifice connected to said shutoff spool chamber and having a pilot line connected to said control spool chamber, a piston first position supply line connected from a first side of said piston to said control spool chamber and a piston second position supply line connected from a second side of said piston to said control spool chamber, and a drain tank line port;

b) a shutoff spool positioned in said shutoff spool chamber said shutoff spool movable between a first open position and a second closed position, said shutoff spool being biased to said first open position and movable to said second closed position by direct physical contact by said piston against said shutoff spool; and c) a control spool positioned in said control spool chamber, to control movement of said intensifier piston.

2. A water saver valve according to claim 1 wherein said shutoff spool is spring biased to said first open position.

3. A water saver valve according to claim 1 wherein said control spool is movable from a first position to a second position by fluid pressure from said pilot line and movable from said second position to said first position by fluid pressure from said control spool supply line, said control spool supply line providing a fluid connection to said piston first position supply line when said control spool is in said first position causing movement of said piston in a first direction, said control spool supply line providing a fluid connection to said piston second position supply line when said control spool is in said second position causing movement of said piston in a second direction, and said piston first position supply line being connected through said control spool to a drain line when said control spool is in said second position.

4. A water saver valve according to claim 3 wherein said control spool supply line provides said fluid connection to said piston first position supply line and to said piston second position supply line through a control spool passageway in said control spool.

5. A water saver valve according to claim 3 wherein said control spool has an outward end which extends at least partially out of a housing containing said control spool chamber and control spool.

6. A water saver valve according to claim 5 wherein said control spool is also movable from a first position to a second position by manually depressing said outward end of said control spool.

7. A water saver valve according to claim 3 wherein said control spool supply line and said pilot line provide equal fluid pressure to opposite ends of said control spool when fluid needs of a water consumption device connected to the outlet is satisfied.

8. A water saver valve according to claim 7 wherein said pilot line provides fluid pressure to a larger surface area of said control spool than is provided by said control spool supply line thus biasing said control spool to said second control spool position when equal fluid pressure is provided to opposite ends of said control spool.

9. A water saver valve according to claim 3 whereby said piston and said control spool are caused to move from said first position to said second position and back to said first position every time fluid is caused to flow from said inlet to said outlet thus reducing the possibility that said moving components might become frozen in place because of infrequent use.

10. A water saver valve according to claim 3 wherein said water saver valve provides an automatic reset function whereby said piston, said shutoff spool and said control spool are each initially biased in a first position which allows fluid to flow unrestricted from said inlet line to said outlet line for a period of time required for said piston to move by fluid pressure to said second position, after fluid needs of a water consumption device are satisfied fluid pressure then causing said control spool to move to said second position and causing said piston to move back to said first position.

11. A water saver valve according to claim 10 wherein said control spool is biased to said first position by fluid pressure when fluid flow is passing from the inlet to the outlet.

12. A water saver valve according to claim 3 wherein said control spool is biased to said first position by fluid pressure when said shutoff spool in a said second closed position.

13. A water saver valve according to claim 3 wherein said control spool is biased to said second position by fluid pressure when a fluid flow cannot pass from said inlet to said outlet because fluid needs of a water consumption device connected to said outlet have been satisfied.

14. A water saver valve according to claim 13 wherein said control spool is biased to said second position by providing a control spool with a larger surface area subjected to fluid pressure from said pilot line and a smaller surface area subjected to fluid pressure from said control spool supply line.

15. A water saver valve according to claim 14 wherein said larger surface area is approximately 1.3 times as large as said smaller surface area.

16. A water saver valve according to claim 3 wherein said water saver valve provides a device failure function whereby if flow continues to enter said inlet for a period of time longer than that required for said piston to move from said first position to said second position said shutoff spool will be pushed to its second closed position, said piston and said shutoff spool will remain in said second position until said control spool is manually reset or until fluid ceases to enter said inlet.

17. A water saver valve according to claim 1 wherein said supply orifice has a diameter of approximately 0.125 inches.

18. A water saver valve according to claim 1 wherein said outlet orifice has an internal diameter of between 0.125 inches and 0.140 inches.

19. A water saver valve according to claim 1 wherein said pilot line has an internal diameter between 0.062 inches and 0.078 inches.

20. A water saver valve according to claim 1 wherein said inlet is connected to a water supply line and said outlet is connected to an inlet to a water consumption device.

21. A water saver valve according to claim 20 wherein said water consumption device is a toilet, washing machine or water heater.

22. A water saver valve according to claim 1 wherein said intensifier piston chamber, said shutoff spool chamber and said control spool chamber are all provided in a single housing.

23. A water saver valve according to claim 1 wherein said an intensifier piston chamber and said shutoff spool chamber are provided in a first housing and said control spool chamber is provided in a second housing hydraulically connected to said first housing.

* * * * *